US005895017A

United States Patent [19]

McMillan, Jr.

[11] Patent Number: 5,895,017

[45] Date of Patent: Apr. 20, 1999

[54] PORTABLE FURNITURE BASE

[76] Inventor: Keith S. McMillan, Jr., 1649 Riverhaven Dr. S, Salem, Oreg. 97302

[21] Appl. No.: 08/927,513

[22] Filed: Sep. 11, 1997

[51] Int. Cl.[6] ..... F16M 11/20

[52] U.S. Cl. ..... 248/188.1; 248/519

[58] Field of Search ..... 248/188.1, 127, 248/346.01, 346.03, 676, 678, 530, 519, 156

[56] References Cited

U.S. PATENT DOCUMENTS

| | | | |
|---|---|---|---|
| 2,263,138 | 11/1941 | Olson | 116/173 |
| 3,332,652 | 7/1967 | Oaks | 248/541 |
| 4,363,460 | 12/1982 | Carroll | 248/415 |
| 4,582,287 | 4/1986 | DeLeary | 248/519 |
| 4,583,705 | 4/1986 | Schmitt | 248/174 |
| 5,120,016 | 6/1992 | Dysarz | 248/539 |
| 5,207,405 | 5/1993 | Cobb | 248/411 |
| 5,685,517 | 11/1997 | Salibra | 248/519 |
| 5,697,190 | 12/1997 | Scribner | 52/165 |

*Primary Examiner*—Ramon O. Ramirez
*Assistant Examiner*—Anita M. King

[57] ABSTRACT

A portable furniture base for attaching a base stand to a deck surface form having a plurality of spaced apart planks so that the stand can be moved to various locations. The portable furniture base includes an upper member, an upper support portion and is mounted on the upper end of a base member. An elongate tension wire disposed in the hollow interior of the base member attaches the base member to a deck by extension of its lower anchoring end through a space between two adjacent planks of the deck. The tension wire anchoring end is rectangular in shape to form a pair of opposing anchoring flange portions which may positioned so that they abut the lower surface of the deck. The tension wire upper end is coupled to a threaded bolt. An adjustment nut disposed on the threaded bolt and is mounted to permit rotation on the base member upper end to provide an adjustment of the tension within the tension wire.

11 Claims, 3 Drawing Sheets

FIG. 1
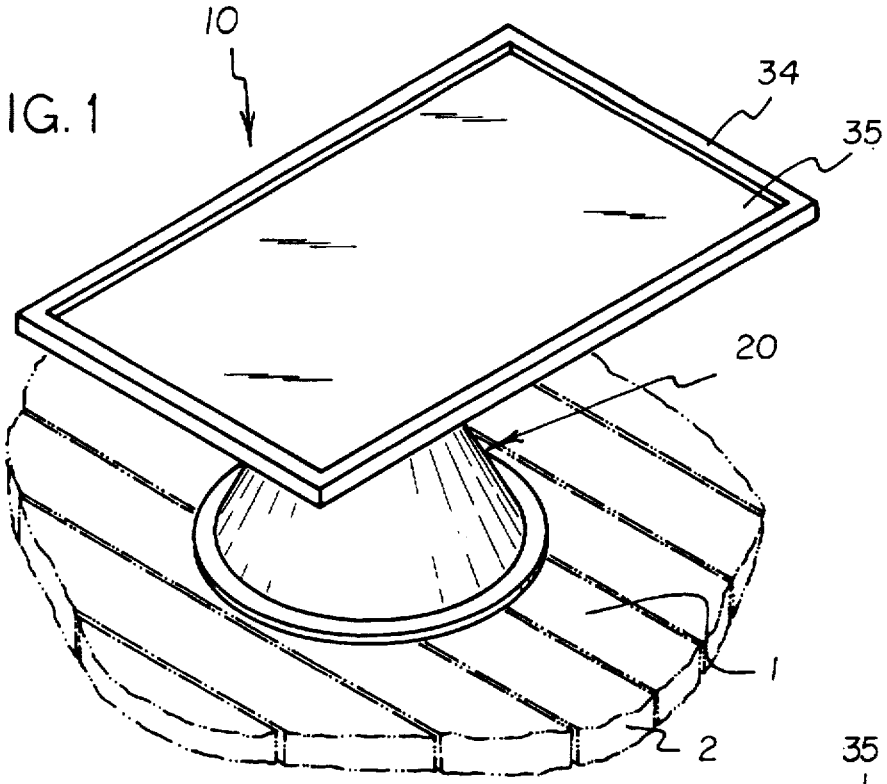
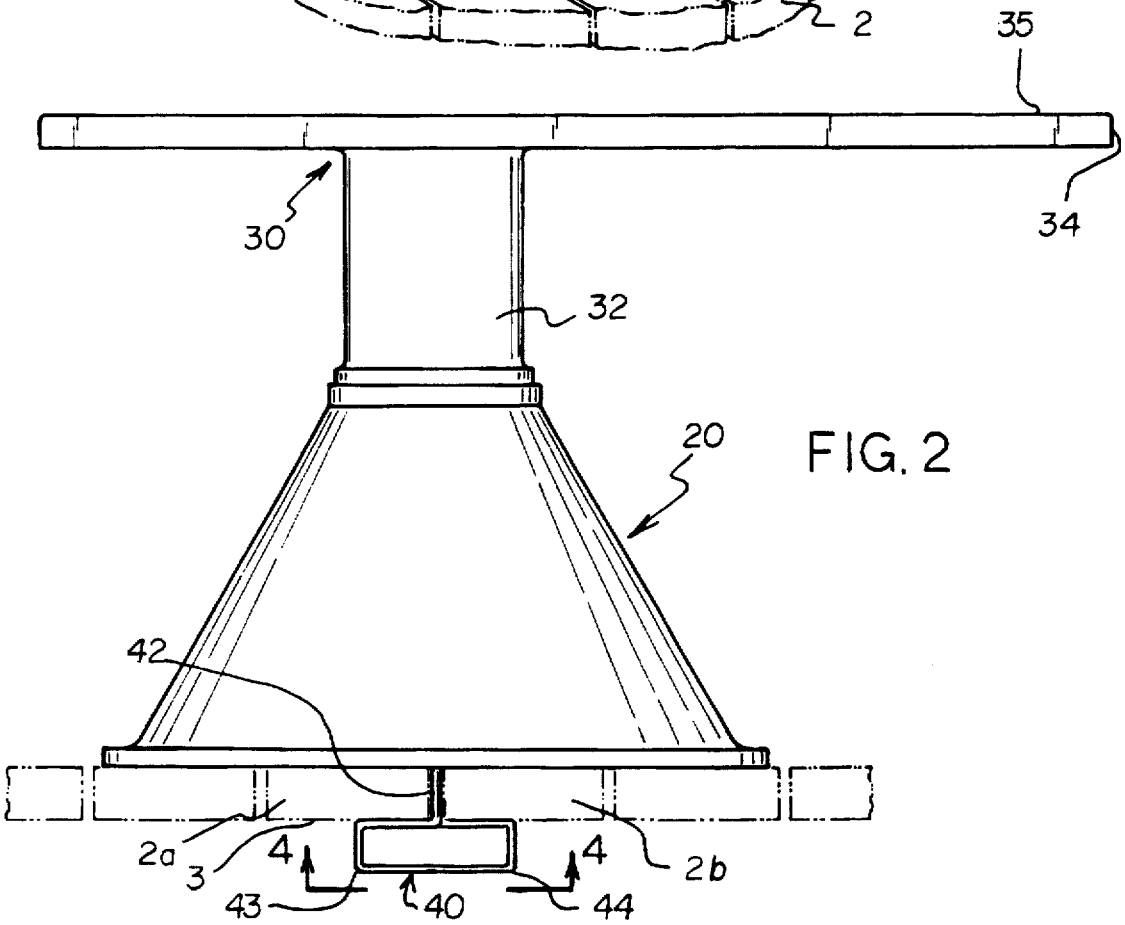
FIG. 2

PORTABLE FURNITURE BASE

BACKGROUND OF THE INVENTION

1. Field of the Invention

The present invention relates to floor stands and more particularly pertains to a new Portable Furniture Base for attaching a base stand to the floor so that the stand can be moved to various locations.

2. Description of the Prior Art

The use of floor stands is known in the prior art. More specifically, floor stands heretofore devised and utilized are known to consist basically of familiar, expected and obvious structural configurations, notwithstanding the myriad of designs encompassed by the crowded prior art which have been developed for the fulfillment of countless objectives and requirements.

Known prior art floor stands include U.S. Pat. No. 4,363,460; U.S. Pat. No. 5,207,405; U.S. Pat. No. 4,583,705; U.S. Pat. No. 259,551; U.S. Pat. No. 289,779 and U.S. Pat. No. 327,788.

While these devices fulfill their respective, particular objectives and requirements, the aforementioned patents do not disclose a new Portable Furniture Base. The inventive device includes a tension nut and a tension wire.

In these respects, the Portable Furniture Base according to the present invention substantially departs from the conventional concepts and designs of the prior art, and into doing provides an apparatus primarily developed for the purpose of attaching a base stand to the floor so that the stand can be moved to various locations.

SUMMARY OF THE INVENTION

In view of the foregoing disadvantages inherent in the known types of floor stands now present in the prior art, the present invention provides a new Portable Furniture Base construction wherein the same can be utilized for attaching a base stand to the floor so that the stand can be moved to various locations.

The general purpose of the present invention, which will be described subsequently in greater detail, is to provide a new Portable Furniture Base apparatus and method which has many of the advantages of the floor stands mentioned heretofore and many novel features that result in a new Portable Furniture Base which is not anticipated, rendered obvious, suggested, or even implied by any of the prior art floor stands, either alone or in any combination thereof.

To attain this, the present invention generally comprises an upper member has a upper support portion and is mounted on the upper end of a base member. An elongate tension wire disposed in the hollow interior of the base member attaches the base member to a deck by extension of its lower anchoring end through a space between two adjacent planks of the deck. The tension wire anchoring end is rectangular in shape to form a pair of opposing anchoring flange portions which may positioned so that they abut the lower surface of the deck. The tension wire upper end is coupled to a threaded bolt. An adjustment nut disposed on the threaded bolt and is mounted to permit rotation on the base member upper end to provide a means for adjusting the tension within the tension wire.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Portable Furniture Base apparatus and method which has many of the advantages of the floor stands mentioned heretofore and many novel features that result in a new Portable Furniture Base which is not anticipated, rendered obvious, suggested, or even implied by any of the prior art floor stands, either alone or in any combination thereof.

It is another object of the present invention to provide a new Portable Furniture Base which may be easily and efficiently manufactured and marketed.

It is a further object of the present invention to provide a new Portable Furniture Base which is of a durable and reliable construction.

An even further object of the present invention is to provide a new Portable Furniture Base which is susceptible of a low cost of manufacture with regard to both materials and labor, and which accordingly is then susceptible of low prices of sale to the consuming public, thereby making such Portable Furniture Base economically available to the buying public.

Still yet another object of the present invention is to provide a new Portable Furniture Base which provides in the apparatuses and methods of the prior art some of the advantages thereof, while simultaneously overcoming some of the disadvantages normally associated therewith.

Still another object of the present invention is to provide a new Portable Furniture Base for attaching a base stand to the floor so that the stand can be moved to various locations. Yet another object of the present invention is to provide a new Portable Furniture Base comprising an upper member has a upper support portion and is mounted on the upper end of a base member. An elongate tension wire disposed in the hollow interior of the base member attaches the base member to a deck by extension of its lower anchoring end through a space between two adjacent planks of the deck. The tension wire anchoring end is rectangular in shape to form a pair of opposing anchoring flange portions which may positioned so that they abut the lower surface of the deck. The tension wire upper end is coupled to a threaded bolt. An adjustment nut disposed on the threaded bolt and is mounted to permit rotation on the base member upper end to provide a means for adjusting the tension within the tension wire.

Still yet another object of the present invention is to provide a new Portable Furniture Base that is portable yet providing a secure attachment to the floor.

Even still another object of the present invention is to provide a new Portable Furniture Base that provides a means of supporting furniture in places such as decks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side perspective view of a new Portable Furniture Base according to the present invention.

FIG. 2 is a side elevation view thereof.

DESCRIPTION OF THE PREFERRED EMBODIMENT

Figure 3:
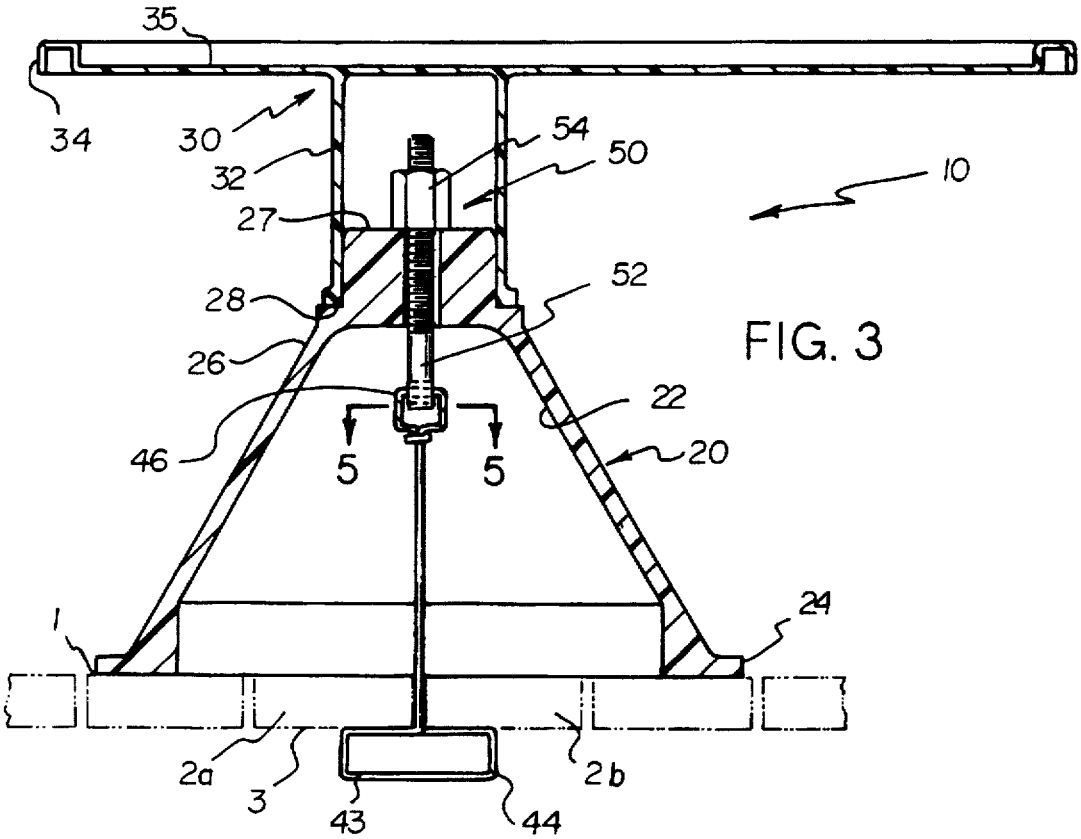
FIG. 3 is a orthographic cross sectional view of the present invention.
Figure 4:
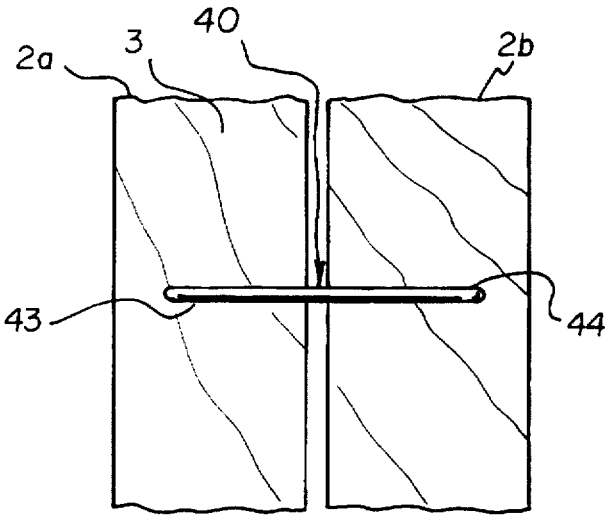
FIG. 4 is a view of the tension wire of the present invention.
Figure 5:
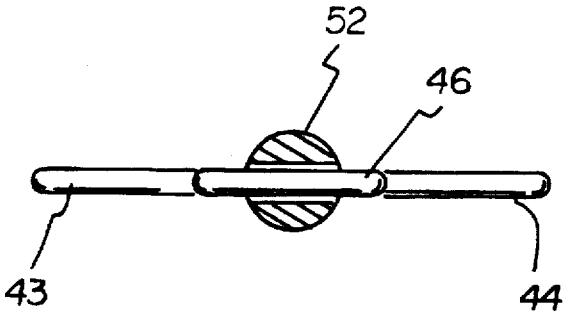
FIG. 5 is a cross sectional view taken along line 5—5 of FIG. 3.
Figure 6:
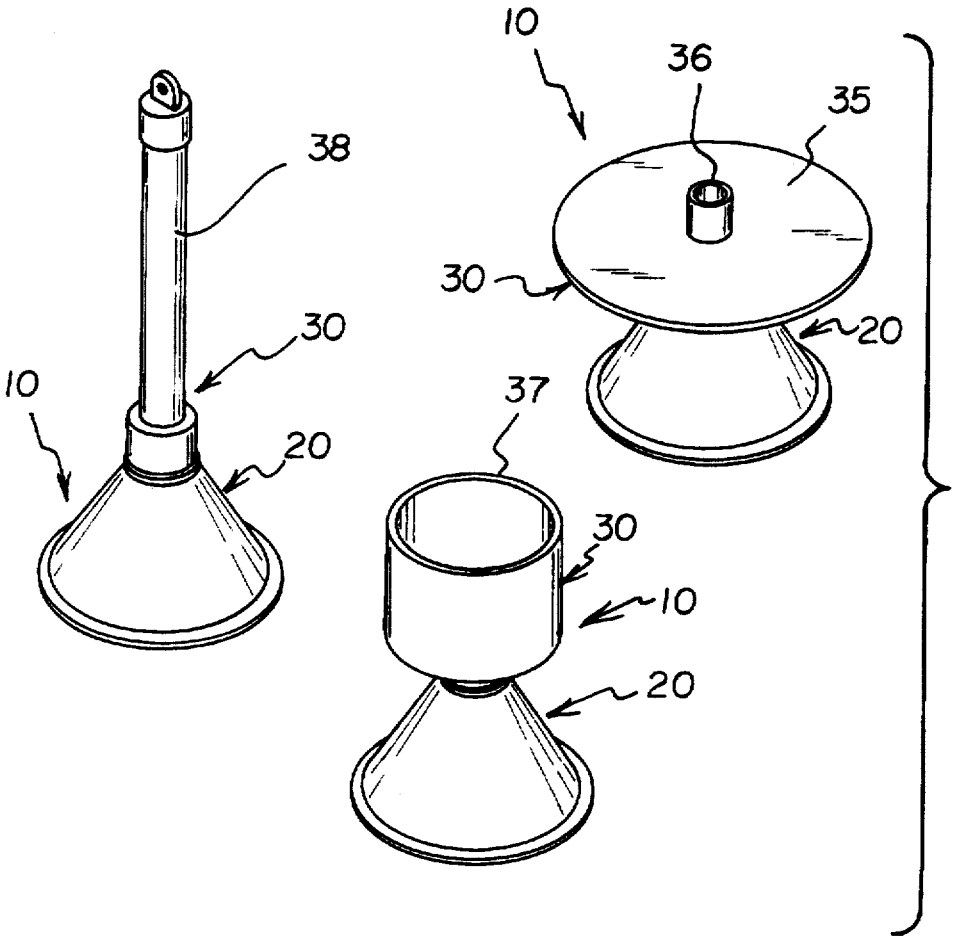
FIG. 6 is a perspective view of three separate embodiments of the present invention.

With reference now to the drawings, and in particular to FIGS. 1 through 6 thereof, a new Portable Furniture Base embodying the principles and concepts of the present invention and generally designated by the reference numeral 10 will be described.

The portable furniture base 10 generally comprises a base member 20, and upper member 30, a tension wire 40, and a tension adjustment means 50. As best illustrated in FIGS. 1 through 6, the portable furniture base 10 is designed for resting on the upper surface of a deck 1 formed by a plurality of substantially parallel and spaced apart elongate planks 2.

The base member 20 has a hollow interior, a lower end 24 and an upper end 26. The upper end includes a nut mounting portion 27 and a upper member mounting portion 28. The base member lower end 24 rests on the deck 1.

Preferably, the elongate tension wire 40 is disposed within the base member hollow interior 22. The tension wire 40 is designed for securely attaching the base member 20 to the deck 1. The lower anchoring end 42 of the tension wire 40 is designed so that it can be extended through the space between two adjacent planks 2*a*, 2*b*. The anchoring end 42 is rectangular in shape to form a pair of opposing anchoring flange portions 43,44 that each extend perpendicularly to the longitudinal axis of the tension wire 40. The anchoring flange portions 43,44 are designed so that they may be positioned against the lower surface 3 deck planks after the attachment end 42 has been inserted through a space between the planks 2*a*, 2*b*.

The portable furniture base 10 also includes a tension adjustment means 50 to adjust the tension within the tension wire 40. Preferably, upper end 46 of the tension wire is coupled to the tension adjustment means. A preferred embodiment of the tension adjustment means 50 includes a threaded bolt 52 which is coupled to the tension wire upper end 46. An adjustment nut 54 is disposed on the threaded bolt 52 and mounted to permit rotation on the nut mounting portion 27 of the base member upper end 26.

The upper member 30 has a mounting portion 32 that is mounted on the base member upper end upper member mounting portion 28. The upper member 30 also includes an upper support portion 34. Preferably, upper support portion 34 forms an upper table portion 35 which may also optionally include a means for attaching an umbrella 36. Optionally, the upper support portion 34 may also be shaped to includes a planter portion 37 or be adapted to hold post 38.

In use, the anchoring flange portions 43,44 are aligned so that they are parallel to the space between the two adjacent planks 2*a*, 2*b* so that the tension wire attachment end 42 may be inserted through the space. The tension wire 40 is then turned by turning the threaded bolt 52 so that the anchoring flange portions are substantially perpendicular with the longitudinal axis of the planks 2*a*, 2*b*, and abut the lower surface of the deck 3. The adjustment nut 32 is rotationally threaded on the threaded bolt 52 to tighten the tension wire 40 to provide the necessary tension to hold the base member to the deck 1.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable furniture base for resting on an upper surface of a deck being formed by a plurality of substantially parallel and spaced apart elongate planks, said portable furniture base comprising:

a conical frustum-shaped base member having a substantially straight outer surface, a hollow interior, an upper end, a cylindrical projection extending upwardly from said upper end, a lip extending outwardly from a perimeter of said cylindrical projiection, a lower end, and a perimeter base flange extending outwardly from said lower end, said lower end being for abutting against the deck upper surface;

an upper member having an upper support portion, a neck portion downwardly disposed from said upper support portion, said neck portion having a hollow interior for snugly receiving said cylindrical projection, said upper member further having a mounting portion positioned at a downward facing surface of said neck portion, said mounting portion being for abutting against said lip of said base member;

an elongate tension wire having an upper end and a lower anchoring end, said lower anchoring end having an open rectangular configuration forming an opening for receiving a user's hand therethrough, said lower anchoring end being for extension through a space between two adjacent planks, said tension wire being disposed within said base member hollow interior;

a pair of opposing anchoring flange portions being formed by said lower anchoring end, each anchoring flange portion being extended perpendicularly to the longitudinal axis of said tension wire, each said anchoring flange portion being for abutment against a deck plank lower surface, a threaded bolt being coupled to said tension wire upper end;

an adjustment nut being disposed on said threaded bolt, said adjustment nut being mounted on said base member upper end to permit rotation of said nut whereby said threaded bolt is urged substantially along a vertical line, said threaded bolt and said adjustment nut providing a tension adjustment means for adjusting the tension within said tension wire such that said opposing anchoring flange portions selectively contact said deck plank lower surface for holding said base member against said deck;

wherein the upper support portion includes a substantially planar upper surface, and wherein the upper surface is has a shape chosen from the group of shapes consisting of a circle, an oval, a square, and a rectangle;

wherein the upper surface has a three sided raised lip disposed from an outer perimeter of the upper surface, said raised lip having a channel extending along an underside thereof for facilitating grasping of the upper support portion, wherein the raised lip includes the three substantially planar sides being configured at right angles with respect to each adjacent side such that said raised lip forms the channel in the underside of the raised lip;

wherein said neck portion is offset from a center of said chosen shape; and wherein the lower end of said base member forms a substantially circular contact surface spaced laterally outward from the lower anchoring end of said tension wire to maximize the area of the deck contacted by said base member and said lower anchoring end.

2. A portable furniture base for resting on an upper surface of a deck being formed by a plurality of substantially parallel and spaced apart elongate planks, said portable furniture base comprising:

a conical frustum-shaped base member having a substantially straight outer surface, a hollow interior, an upper end, a cylindrical projection extending upwardly from said upper end, a lip extending outwardly from a perimeter of said cylindrical projection, a lower end, and a perimeter base flange extending outwardly from said lower end, said lower end being for abutting against the deck upper surface;

an upper member having an upper support portion, a neck portion downwardly disposed from said upper support portion, said neck portion having a hollow interior for snugly receiving said cylindrical projection, said upper member further having a mounting portion positioned at a downward facing surface of said neck portion, said mounting portion being for abutting against said lip of said base member;

an elongate tension wire having an upper end and a lower anchoring end, said lower anchoring end having an open rectangular configuration forming an opening for receiving a user's hand therethrough, said lower anchoring end being for extension through a space between two adjacent planks, said tension wire being disposed within said base member hollow interior;

a pair of opposing anchoring flange portions being formed by said lower anchoring end, each anchoring flange portion being extended perpendicularly to the longitudinal axis of said tension wire, each said anchoring flange portion being for abutment against a deck plank lower surface;

a threaded bolt being coupled to said tension wire upper end;

an adjustment nut being disposed on said threaded bolt, said adjustment nut being mounted on said base member upper end to permit rotation of said nut whereby said threaded bolt is urged substantially along a vertical line, said threaded bolt and said adjustment nut providing a tension adjustment means for adjusting the tension within said tension wire such that said opposing anchoring flange portions selectively contact said deck plank lower surface for holding said base member against said deck.

3. The portable furniture base of claim 2, wherein said upper support portion forms a structure chosen from the group of structures consisting of a table and a planter.

4. The portable furniture base of claim 2, wherein said upper support portion comprises a table and includes a means for attaching an umbrella.

5. The portable furniture base of claim 2, wherein said upper support portion is adapted to hold a post.

6. The portable furniture base of claim 2, wherein the upper support portion includes a substantially planar upper surface; and wherein the upper surface is has a shape chosen from the group of shapes consisting of a circle, an oval, a square, and a rectangle.

7. The portable furniture base of claim 6, wherein the upper surface has a three sided raised lip disposed from an outer perimeter of the upper surface, said raised lip having a channel extending along an underside thereof for facilitating grasping of the upper support portion.

8. The portable furniture base of claim 1, wherein the raised lip includes the three substantially planar sides being configured at right angles with respect to each adjacent side such that said raised lip forms the channel in the underside of the raised lip.

9. The portable furniture base of claim 6, wherein said neck portion is offset from a center of said chosen shape.

10. The portable furniture base of claim 2, wherein the lower end of said base member forms a substantially circular contact surface spaced laterally outward from the lower anchoring end of said tension wire to maximize the area of the deck contacted by said base member and said lower anchoring end.

11. The portable furniture base of claim 2, wherein said elongate tension wire defines a longitudinal axis, and wherein said lower end of said base member is adapted to contact the deck upper surface at a location spaced laterally outward from the area of said lower deck surface contacted by said loop to thereby enhance the stability of said base member when mounted on the deck.

* * * * *